US010260116B2

(12) United States Patent
Takezaki et al.

(10) Patent No.: US 10,260,116 B2
(45) Date of Patent: Apr. 16, 2019

(54) APPARATUS FOR SHAVING TAP HOLE SURFACE OF BLAST FURNACE OR THE LIKE

(71) Applicant: TRYTEC CO., LTD., Oita-shi, Oita (JP)

(72) Inventors: Hiroshi Takezaki, Oita (JP); Shinichi Fujisawa, Tokyo (JP)

(73) Assignee: TRYTEC CO., LTD., Oita-shi (JP)

( * ) Notice: Subject to any disclaimer, the term of this patent is extended or adjusted under 35 U.S.C. 154(b) by 185 days.

(21) Appl. No.: 15/326,392

(22) PCT Filed: Dec. 25, 2015

(86) PCT No.: PCT/JP2015/086322
§ 371 (c)(1),
(2) Date: Jan. 13, 2017

(87) PCT Pub. No.: WO2016/163057
PCT Pub. Date: Oct. 13, 2016

(65) Prior Publication Data

US 2017/0204484 A1 Jul. 20, 2017

(30) Foreign Application Priority Data

Apr. 6, 2015 (JP) ..... 2015-077785

(51) Int. Cl.
*C21B 7/12* (2006.01)
*F27D 25/00* (2010.01)
(Continued)

(52) U.S. Cl.
CPC ..... *C21B 7/12* (2013.01); *C21C 5/4653* (2013.01); *F27D 3/1536* (2013.01); *F27D 25/001* (2013.01)

(58) Field of Classification Search
CPC ..... C21B 7/12
See application file for complete search history.

(56) References Cited

U.S. PATENT DOCUMENTS

2017/0204484 A1* 7/2017 Takezaki ..... F27D 25/001

FOREIGN PATENT DOCUMENTS

CN 201746559 U 2/2011
CN 202266190 U 6/2012
(Continued)

OTHER PUBLICATIONS

Machine Translation of KR 101423526 (Year: 2014).*
(Continued)

*Primary Examiner* — Scott R Kastler
(74) *Attorney, Agent, or Firm* — Oliff PLC

(57) ABSTRACT

An apparatus for shaving a tap hole surface of a blast furnace or the like wherein efficiency can be improved, and a worker can be freed from physically burdensome work in the vicinity of the lower furnace wall of a blast furnace under high temperature. The apparatus includes a surface shaving unit having smoothing bits, and a rotating mechanism unit that, when the surface shaving unit is pressed against the tap hole surface, rotates the surface shaving unit, by utilizing the pressing force, by a predetermined angle in a predetermined direction substantially parallel to the surface, and holds the surface shaving unit at the rotated position. The rotating mechanism unit eliminates the need for work such that every time a conventional surface shaving unit is separated from the tap hole surface after being pressed against the surface, a worker manually rotates the surface shaving unit by a predetermined angle.

6 Claims, 13 Drawing Sheets

(51) Int. Cl.
*C21C 5/46* (2006.01)
*F27D 3/15* (2006.01)

(56) References Cited

FOREIGN PATENT DOCUMENTS

| | | | | |
|---|---|---|---|---|
| CN | 202945256 | U | | 5/2013 |
| JP | 2000-328117 | A | | 11/2000 |
| KR | 100815883 | B1 | * | 3/2008 |
| KR | 101423526 | B1 | * | 8/2014 |

OTHER PUBLICATIONS

Machine Translation of KR 100815883 (Year: 2008).*
Feb. 5, 2018 Chinese Office Action issued in Chinese Patent Application No. 201580037889.3.

* cited by examiner

CONVENTIONAL

APPARATUS FOR SHAVING TAP HOLE SURFACE OF BLAST FURNACE OR THE LIKE

TECHNICAL FIELD

The present invention relates to an apparatus for shaving a tap hole surface of a blast furnace or the like, for shaving and smoothing a tap hole surface (a front surface of a tap hole and an area around it) of a blast furnace or the like.

BACKGROUND ART

Conventionally, a tap hole is opened in the lower portion of the furnace wall of a blast furnace or the like with a hole opening machine, and, after the tapping, mud is injected into the tap hole with a mud injection machine so as to close the tap hole.

Molten iron and so forth adhere to the tap hole surface and solidify during the tapping, and the tap hole surface often becomes uneven. If such unevenness is present, when closing the tap hole with the mud injection machine, the end face of the injection nozzle of the mud injection machine cannot be in close contact with the tap hole surface, mud leaks to the outside, and the work of injecting mud cannot be performed efficiently. Therefore, conventionally, the tap hole surface is smoothed using an apparatus for smoothing a tap hole surface. FIG. 13 is a diagram showing an example of such a conventional apparatus for smoothing a tap hole surface, reference sign M denotes a mud injection machine, reference sign C denotes an apparatus for smoothing a tap hole surface that is attached to the distal end of the mud injection machine M interchangeably with a mud injection nozzle (not shown), reference sign R denotes a blast furnace, reference sign S denotes a tap hole surface, and reference sign K denotes a smoothed surface.

Heretofore, various apparatuses for smoothing a tap hole surface have been proposed. Conventionally, a typical apparatus for smoothing a tap hole surface is, for example, such that an injection nozzle attached to the distal end of a conventional mud injection machine is removed, and instead a disk-shaped surface smoothing unit having smoothing bits (many hard protrusions) is detachably attached. In the work of smoothing the tap hole surface performed by using such a conventional apparatus for smoothing a tap hole surface, the surface smoothing unit is pressed (slapped) against the tap hole surface with a drive mechanism provided in the conventional mud injection machine (a drive mechanism for moving an injection nozzle attached to the distal end of the mud injection machine toward and away from the tap hole), and the tap hole surface is thereby smoothed.

CITATION LIST

Patent Literature

PTL 1: Japanese Unexamined Patent Application Publication No. 2000-328117

PTL 2: Japanese Unexamined Patent Application Publication No. 7-3311

SUMMARY OF INVENTION

Technical Problem

When performing the work of smoothing the tap hole surface using the above-described conventional apparatus for smoothing a tap hole surface, the whole tap hole surface cannot be smoothed uniformly by just repeating the step of pressing the surface smoothing unit against the tap hole surface because each bit of the surface smoothing unit is simply pressed against the same point on the tap hole surface. Therefore, conventionally, a work such that a worker manually rotates the surface smoothing unit by a predetermined angle so as to change the positions of the bits of the surface smoothing unit little by little, is interposed between the pressing step of pressing (slapping) the surface smoothing unit having the smoothing bits against the tap hole surface and the next pressing step of the same content, that is, every time the surface smoothing unit is separated from the tap hole surface after being pressed against the tap hole surface.

However, there is a problem in that interposing a work such that a worker manually rotates the surface smoothing unit by a predetermined angle every time the surface smoothing unit is separated from the tap hole surface after being pressed against the tap hole surface, significantly reduces the efficiency of the work of smoothing the tap hole surface, and results in imposing a physically burdensome work in the vicinity of the lower furnace wall of the blast furnace under high temperature on the worker.

PTL 1 proposes an apparatus for smoothing a tap hole surface including a guide pin fixed to the drive mechanism, a guide groove formed on the outer peripheral surface of a guide tube fixed to the surface smoothing unit, in a direction inclined with respect to the moving direction of the surface smoothing unit, and a spring that urges the surface smoothing unit toward the tap hole surface and that moves the guide pin along the guide groove by its own force during the return operation after pressing the surface smoothing unit against the tap hole surface. When using the apparatus for smoothing a tap hole surface proposed by PTL 1, the surface smoothing unit can be rotated by a predetermined angle during the return operation after pressing the surface smoothing unit against the tap hole surface, and therefore the above-described "work such that a worker manually rotates the surface smoothing unit by a predetermined angle every time the surface smoothing unit is separated from the tap hole surface after being pressed against the tap hole surface" is not necessary, to be sure. But, there is a problem in that when performing the work of smoothing the tap hole surface using the conventional apparatus for smoothing a tap hole surface proposed by PTL 1, at the stage of pressing the surface smoothing unit against the tap hole surface, the surface smoothing unit is simply pressed against the tap hole surface without rotating, and therefore the efficiency of smoothing the tap hole surface by the operation of pressing the surface smoothing unit is poor, and as a result, the number of repetitions of the step of pressing the surface smoothing unit is increased, and working time is increased.

The present invention has been made in view of such problems of the conventional art, and it is an object of the present invention to provide an apparatus for shaving a tap hole surface of a blast furnace or the like such that, by eliminating the need for a work such that every time a surface shaving unit is separated from the tap hole surface after being pressed against the tap hole surface, a worker manually rotates the surface shaving unit by a predetermined angle, the efficiency of shaving and smoothing the tap hole surface can be increased, the worker can be freed from a physically burdensome work in the vicinity of the lower furnace wall of the blast furnace under high temperature, and the efficiency of shaving and smoothing the tap hole surface by the operation of pressing the surface shaving unit can be greatly improved than ever before.

Solution to Problem

An apparatus for shaving a tap hole surface according to the present invention for solving the above problems includes a surface shaving unit that is pressed against a tap hole surface (a front surface of a tap hole and an area around it) of a blast furnace or the like and is used for shaving and smoothing the tap hole surface, and that has bits, and a rotating mechanism unit that, when the surface shaving unit is pressed against the tap hole surface, rotates the surface shaving unit, by utilizing the pressing force, by a predetermined angle in a predetermined direction substantially parallel to the tap hole surface, and holds the surface shaving unit at the rotated position.

In the apparatus for shaving a tap hole surface according to the present invention, the rotating mechanism unit may include a movable body to an end of which nearer to the tap hole surface the surface shaving unit is attached or fixed, a tubular body that houses the movable body movably toward and away from the tap hole surface, a first gear unit that is provided in the movable body and that moves toward a below-described second gear unit when the surface shaving unit is pressed against the tap hole surface, a second gear unit that is provided in a portion of the tubular body that is farther from the tap hole surface than the first gear unit, and that, in the process in which the first gear unit approaches itself and then teeth of the first gear unit and teeth of itself mesh with each other, rotates the first gear unit and the movable body to which the first gear unit is fixed, by a predetermined angle in a predetermined direction substantially parallel to the tap hole surface, a third gear unit that is provided in a portion of the movable body that is nearer to the tap hole surface than the first gear unit, and that, when the surface shaving unit is separated from the tap hole surface, moves toward a below-described fourth gear unit, and a fourth gear unit that is provided in a portion of the tubular body that is nearer to the tap hole surface than the third gear unit, and that, in the process in which the third gear unit approaches itself and then teeth of the third gear unit and teeth of itself mesh with each other, rotates the third gear unit and the movable body to which the third gear unit is fixed, by a predetermined angle in the predetermined direction.

In the apparatus for shaving a tap hole surface according to the present invention, the rotating mechanism unit may include a movable body to an end of which nearer to the tap hole surface the surface shaving unit is attached or fixed, a tubular body that houses the movable body movably toward and away from the tap hole surface, a first gear unit that is provided in the movable body and that moves toward a below-described second gear unit when the surface shaving unit is pressed against the tap hole surface, a second gear unit that is provided in a portion of the tubular body that is farther from the tap hole surface than the first gear unit, a third gear unit that is provided in a portion of the movable body that is nearer to the tap hole surface than the first gear unit, and that, when the surface shaving unit is separated from the tap hole surface, moves toward a below-described fourth gear unit, and a fourth gear unit that is provided in a portion of the tubular body that is nearer to the tap hole surface than the third gear unit, and teeth of the first gear unit and teeth of the second gear unit may be each formed in a saw-tooth shape such that, in the process in which the first gear unit approaches the second gear unit and then the teeth of the first gear unit and the teeth of the second gear unit mesh with each other, the first gear unit and the movable body to which the first gear unit is fixed rotate by a predetermined angle in a predetermined direction substantially parallel to the tap hole surface, and teeth of the third gear unit and teeth of the fourth gear unit may be each formed in a saw-tooth shape such that, in the process in which the third gear unit approaches the fourth gear unit and then the teeth of the third gear unit and the teeth of the fourth gear unit mesh with each other, the third gear unit and the movable body to which the third gear unit is fixed rotate by a predetermined angle in the predetermined direction.

The apparatus for shaving a tap hole surface according to the present invention preferably further includes a spring that urges the movable body relative to the tubular body in the direction of the tap hole surface.

In the apparatus for shaving a tap hole surface according to the present invention, a thrust bearing may be provided between each end of the spring and the tubular body.

Advantageous Effects of Invention

In the present invention, when the surface shaving unit is pressed (brought into contact and pressed) against the tap hole surface by the drive mechanism unit, the surface shaving unit is rotated, by utilizing pressing force when the surface shaving unit is pressed (by converting the pressing force into rotational force), by a predetermined angle in a predetermined direction substantially parallel to the tap hole surface (the circumferential direction of the tubular body), and is held at the rotated position. Therefore, according to this embodiment, "the work such that the worker manually rotates the surface shaving unit by a predetermined angle between the operation of pressing the disk-like surface shaving unit against the tap hole surface and the operation of thereafter further pressing the surface shaving unit against the tap hole surface, that is, every time the surface shaving unit is separated from the tap hole surface after being pressed against the tap hole surface, which has been required in the work of shaving and smoothing the tap hole surface using a conventional apparatus for shaving a tap hole surface, is performed without providing an expensive drive mechanism, such as a motor, proposed in PTL 2, by utilizing the function of moving linearly back and forth relative to the tap hole surface possessed by the mat injection machine itself, and therefore can be made unnecessary at a low facility cost, and as a result, the efficiency of the work of smoothing the tap hole surface of a blast furnace or the like can be improved greatly. According to the present invention, making the worker perform a conventionally needed very hard work of manually rotating the surface shaving unit 1 by a predetermined angle in the vicinity of the lower furnace wall of the blast furnace under high temperature every time the surface shaving unit 1 is separated from the tap hole surface after being pressed against the tap hole surface, can be made unnecessary, and imposing such a large physical burden on the worker can be avoided.

According to the present invention, in the process in which the surface shaving unit is pressed against the tap hole surface, the surface shaving unit rotates by a predetermined angle, and the bits of the surface shaving unit not only operate so as to shave the tap hole surface of a blast furnace or the like in the front-back direction (the direction toward and away from the tap hole surface) but also operate so as shave in the direction of rotation (a direction substantially parallel to the tap hole surface), and therefore, compared to the case where the surface shaving unit is simply pressed against the tap hole surface in the front-back direction as in the past, the amount of shaving per single operation of pressing the surface shaving unit against the tap hole surface can be significantly increased.

When, in the present invention, a first gear unit provided in the movable body, a second gear unit provided in a portion of the tubular body that is farther from the tap hole surface than the first gear unit, a third gear unit provided in a portion of the movable body that is nearer to the tap hole surface than the first gear unit, and a fourth gear unit provided in a portion of the tubular body that is nearer to the tap hole surface than the third gear unit, are provided, (a) the operation of rotating the first gear unit and the movable member fixed to this, by a predetermined angle in a predetermined direction substantially parallel to the tap hole surface (circumferential direction of the tubular body) in the process in which, when the surface shaving unit is pressed against the tap hole surface, the first gear unit moves toward the second gear unit, and the teeth of the first gear unit mesh with the teeth of the second gear unit, and (b) the operation of rotating the third gear unit and the movable member fixed to this, by a predetermined angle in the predetermined direction (circumferential direction of the tubular body) in the process in which, when a transition is made from the state where the surface shaving unit is pressed against the tap hole surface to the state where the surface shaving unit is separated from the tap hole surface, the third gear unit moves toward the fourth gear unit, and the teeth of the third gear unit mesh with the teeth of the fourth gear unit, can be achieved with a simple and low-cost configuration.

When, in the present invention, (A) the first gear unit and the second gear unit are each formed in a saw-tooth shape such that, when their respective teeth mesh with each other, the first gear unit rotates relative to the second gear unit by a predetermined angle in a predetermined direction substantially parallel to the tap hole surface (circumferential direction of the tubular body), and (B) the third gear unit and the fourth gear unit are each formed in a saw-tooth shape such that, when their respective teeth mesh with each other, the third gear unit rotates relative to the fourth gear unit by a predetermined angle in the predetermined direction (circumferential direction of the tubular body), (a) the operation of rotating the first gear unit and the movable member to which this is fixed, by a predetermined angle in a predetermined direction substantially parallel to the tap hole surface (circumferential direction of the tubular body) in the process in which, when the surface shaving unit is pressed against the tap hole surface, the first gear unit moves toward the second gear unit, and the teeth of the first gear unit mesh with the teeth of the second gear unit, and (b) the operation of rotating the third gear unit and the movable member to which the third gear unit is fixed, by a predetermined angle in the predetermined direction (circumferential direction of the tubular body) in the process in which, when a transition is made from the state where the surface shaving unit is pressed against the tap hole surface to the state where the surface shaving unit is separated from the tap hole surface, the third gear unit moves toward the fourth gear unit, and the teeth of the third gear unit mesh with the teeth of the fourth gear unit, can be achieved with a simple and low-cost configuration.

When, in the present invention, a spring that urges the movable body relative to the tubular body toward the tap hole surface is provided, (a) the operation in which, when the surface shaving unit is pressed against the tap hole surface, the first gear unit moves (against the force of the spring) toward the second gear unit, and the teeth of the first gear unit mesh with the teeth of the second gear unit, and (b) the operation in which, when a transition is made from the state where the surface shaving unit is pressed against the tap hole surface to the state where the surface shaving unit is separated from the tap hole surface, the third gear unit moves (against the force of the spring) toward the fourth gear unit, and the teeth of the third gear unit mesh with the teeth of the fourth gear unit, can be achieved with a simple and low-cost configuration.

When, in the present invention, a thrust bearing is provided between each end of the spring and the tubular body, interference with smooth rotating operation of the movable body relative to the tubular body caused by the friction between each end of the spring and the tubular body, for example, the rotation of the spring during the rotation of the movable body, can be effectively prevented.

DESCRIPTION OF EMBODIMENTS

Figure 1:
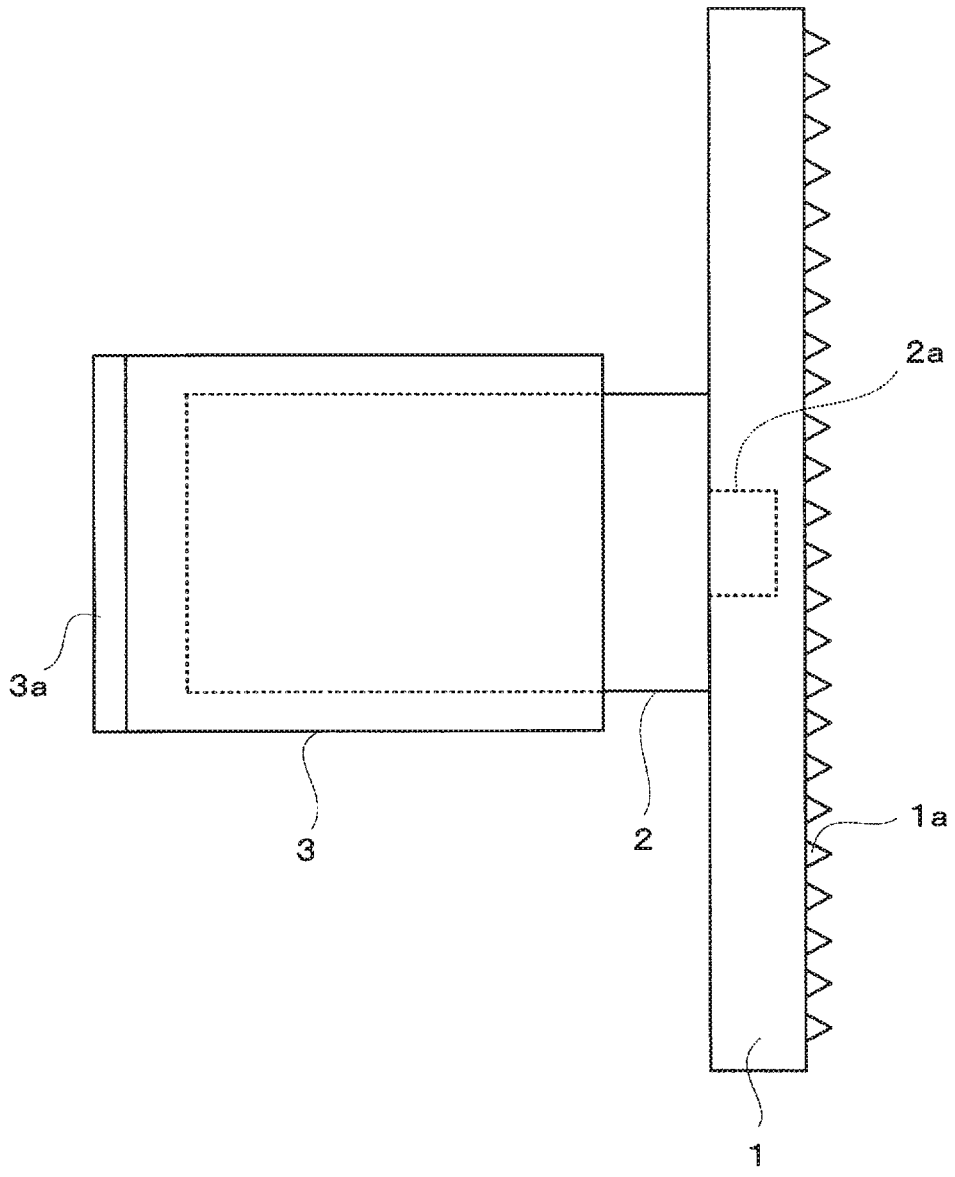
FIG. 1 is an external view showing the configuration of an apparatus for shaving a tap hole surface according to an embodiment of the present invention.
Figure 2:
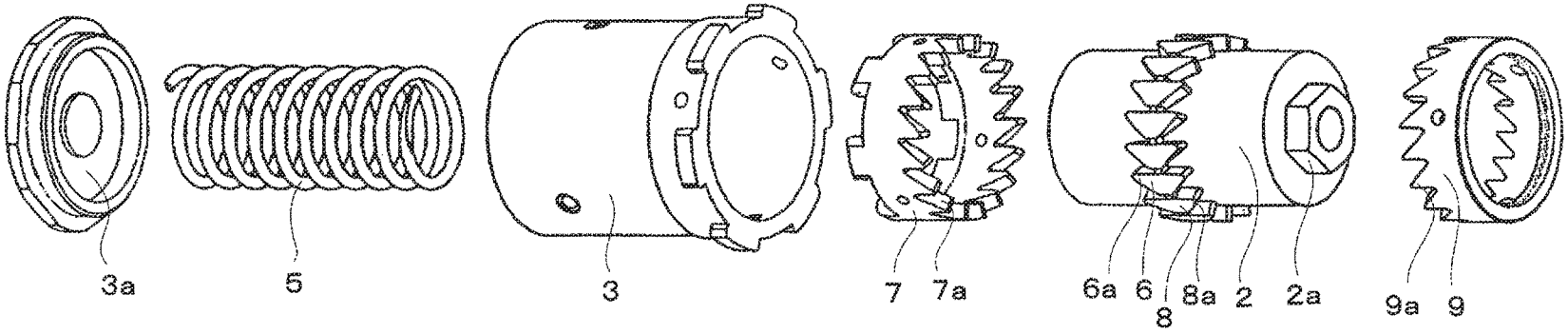
FIG. 2 is an exploded perspective view showing a rotating mechanism unit for rotating a surface shaving unit in this embodiment.
Figure 3:
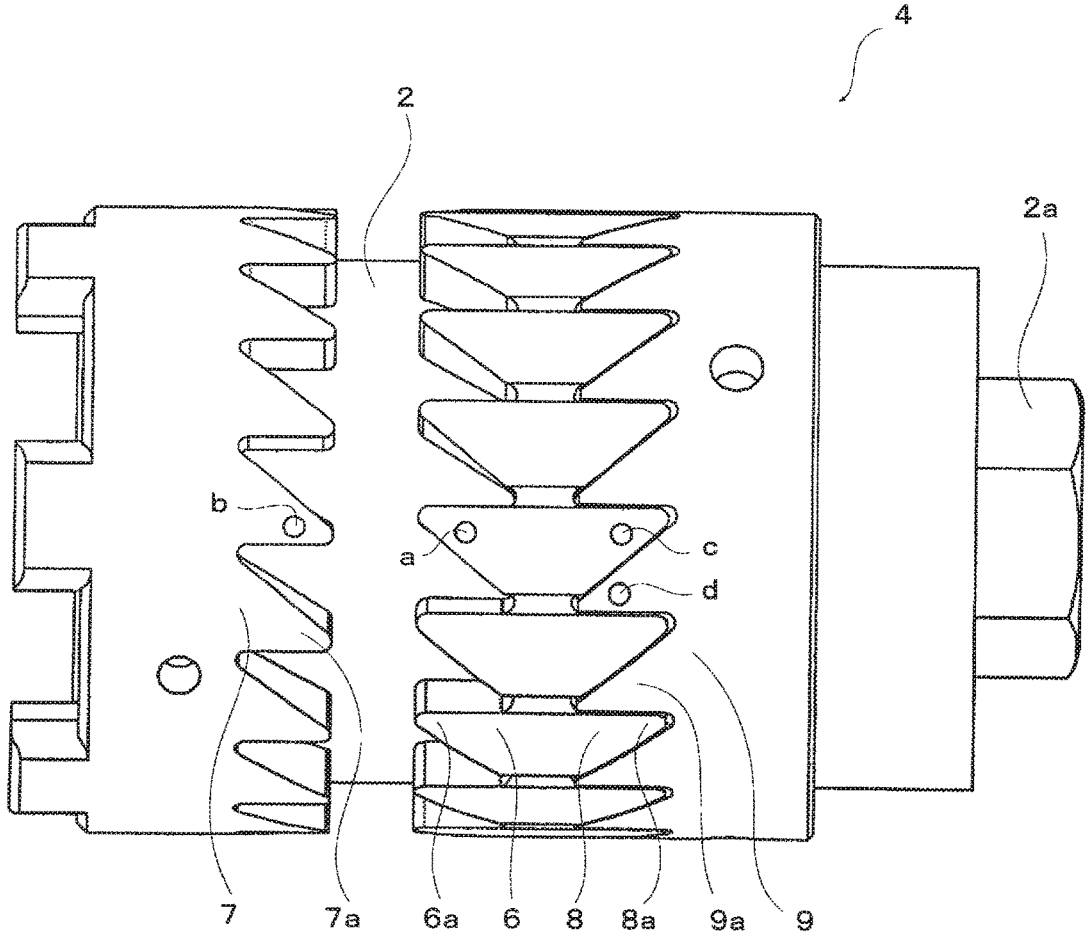
FIG. 3 is a diagram for illustrating the configuration and operation of the rotating mechanism unit of this embodiment.
Figure 4:
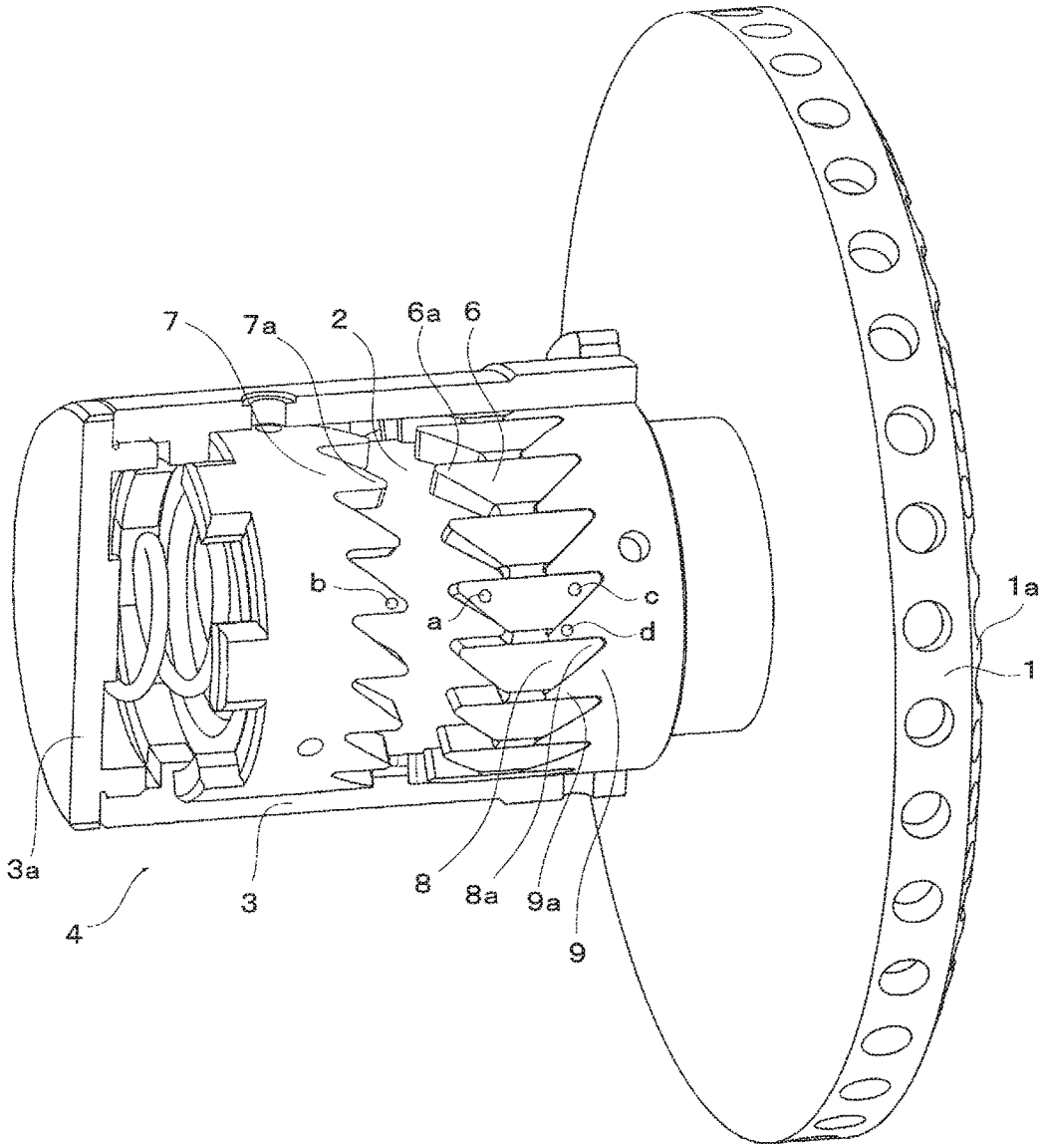
FIG. 4 is a diagram for illustrating the configuration and operation of the rotating mechanism unit of this embodiment.

An embodiment of the present invention will be described below with reference to the drawings. FIG. 1 is a side view showing the appearance of an apparatus for shaving a tap hole surface according to an embodiment of the present invention, FIG. 2 is an exploded perspective view showing a rotating mechanism unit 4 housed in the housing 3, and FIG. 3 and FIG. 4 are diagrams showing the configuration and operation of the rotating mechanism unit 4.

In FIGS. 1 to 4, reference sign 1 denotes a disk-shaped surface shaving unit that is pressed against a tap hole surface (a front surface of a tap hole and an area around it) of a blast furnace or the like, reference sign 1*a* denotes many protruding bits that are disposed on and fixed to a flat surface of the surface shaving unit 1 that faces the tap hole surface, reference sign 2 denotes a cylindrical movable body that moves toward and away from the tap hole surface with the surface shaving unit 1 (not shown in FIGS. 2 and 3) attached to the distal end portion thereof, and reference sign 2*a* denotes a portion that is the distal end portion of the movable body 2 and to which the surface shaving unit 1 is attached. The movable body 2 is formed in a substantially cylindrical shape. The distal end portion 2*a* thereof to which the surface shaving unit 1 is attached is closed, whereas the other left in the figure end portion is open (a spring to be described later is inserted into the movable body 2 from the left in the figure end thereof).

In FIGS. 1 to 4, reference sign 3 denotes a cylindrical housing that houses the movable body 2 movably toward and away from the tap hole surface, reference sign 3*a* denotes a bottom plate that closes an opening at the end of the housing 3 opposite to the surface shaving unit 1, and reference sign 5 denotes a spring that is interposed between the bottom plate 3*a* and the distal end portion 2*a* of the movable body 2 (which is closed as described above). The spring 5 always urges the movable body 2 in the direction of the tap hole surface relative to the bottom plate 3*a*.

In FIGS. 1 to 4, reference sign 6 denotes a first gear unit 6 that is provided fixedly by welding or the like on a substantially central portion in the moving direction of the movable body 2, of the outer peripheral wall surface of the movable body 2, and in which a plurality of teeth 6*a* protruding in a direction opposite to the distal end portion 2*a* are arranged as a whole in a ring shape along the circumferential direction of the movable body 2, reference sign 7 denotes a second gear unit that is provided fixedly with screws or the like on a portion of the inner peripheral wall surface of the housing 3 that is nearer to the bottom plate 3*a* than the first gear unit 6 (a portion on the side opposite to the distal end portion 2*a*), and in which a plurality of teeth 7*a* that can mesh with the plurality of teeth 6*a* of the first gear unit 6 and that protrude in the direction of the distal end portion 2*a* are arranged as a whole in a ring shape along the circumferential direction of the housing 3, reference sign 8 denotes a third gear unit 8 that is provided fixedly by welding or the like on a portion of the outer peripheral wall surface of the movable body 2 that is nearer to the distal end portion 2*a* than the first gear unit 6, and in which a plurality of teeth 8*a* protruding in the direction of the distal end portion 2*a* are disposed as a whole in a ring shape along the circumferential direction of the movable body 2, and reference sign 9 denotes a fourth gear unit 9 that is provided fixedly with screws or the like on a portion of the inner peripheral wall surface of the housing 3 that is nearer to the distal end portion 2*a* than the third gear unit 6 (right-hand portion in the figure), and in which a plurality of teeth 9*a* that can mesh with the plurality of teeth 8*a* of the third gear unit 8 and that protrude in a direction opposite to the distal end portion 2*a* are arranged as a whole in a ring shape along the circumferential direction of the housing 3. In this embodiment, the first gear unit 6 and the third gear unit 8 are formed integrally with each other.

In this embodiment, although details will be described later, the first gear unit 6 and the second gear unit 7 are each formed in a saw-tooth shape such that, when the teeth 6*a* and the teeth 7*a* are meshed with each other, the first gear unit 6 rotates relative to the second gear unit 7 by a predetermined angle (for example, 15 degrees) in a predetermined direction (clockwise direction as viewed from the side of the surface shaving unit 1 in this embodiment) substantially parallel to the tap hole surface. In this embodiment, although details will be described later, the third gear unit 8 and the fourth gear unit 9 are each formed in a saw-tooth shape such that, when the teeth 8*a* and 9*a* are meshed with each other, the third gear unit 8 rotates relative to the fourth gear unit 9 by a predetermined angle (for example, 15 degrees) in a predetermined direction (clockwise direction as viewed from the side of the surface shaving unit 1 in this embodiment) substantially parallel to the tap hole surface.

The apparatus for shaving a tap hole surface according to this embodiment that includes the surface shaving unit 1, the housing 3, and the rotating mechanism unit 4 as described above is desirably attached to the distal end portion of a conventional mud injection machine detachably (interchangeably with a mud injection nozzle). In the work of shaving and smoothing the tap hole surface, a step in which the apparatus for shaving a tap hole surface according to this embodiment is moved toward the tap hole surface by a drive mechanism that is originally provided in the conventional mud injection machine, and the surface shaving unit 1 is pressed against the tap hole surface, and a step in which the apparatus for shaving a tap hole surface according to this embodiment is moved away from the tap hole surface, and the surface shaving unit 1 is separated from the tap hole surface, are alternately repeated. The apparatus for shaving a tap hole surface according to this embodiment may not only be used attached to the distal end portion (portion to which a mud injection nozzle is attached) of the conventional mud injection machine but may also be used attached to another dedicated machine.

Further, in this embodiment, thrust bearings (not shown) are provided between an end portion of the spring 5 that is nearer to the surface shaving unit 1 and the distal end portion 2*a* of the movable body 2, and between an end portion of the spring 5 that is nearer to the bottom plate 3*a* of the housing 3 and the bottom plate 3*a*.

Next, the operation of this embodiment will be described with reference to FIG. 3 to FIG. 12. First, a state before pressing the surface shaving unit 1 (see FIG. 1) against the tap hole surface will be described with reference to FIG. 3 and FIG. 4. In this state, as shown in FIG. 3 and FIG. 4, the movable body 2 is urged by the spring 5 (see FIG. 4) in the direction of the tap hole surface (rightward in FIGS. 3 and 4) relative to the bottom plate 3*a* of the housing 3, and therefore the teeth 8*a* of the third gear unit 8 on the tap hole surface side (right side in the figure) of the movable body 2 are meshed with the teeth 9*a* of the fourth gear unit 9 on the tap hole surface side (right side in the figure) of the housing 3 (see marks indicated by reference signs c and d in FIGS. 3 and 4).

Next, the operation in the process of pressing the surface shaving unit 1 (see FIG. 4) against the tap hole surface will be described with reference to FIG. 5 and FIG. 6. In this process, the movable member 2 is moved by the force of the drive mechanism of the conventional mud injection machine to press the surface shaving unit 1 against the tap hole surface, against the force of the spring 5, away from the surface shaving unit 1 (in the direction indicated by arrow A in FIG. 5). In the process of this movement, as shown in FIG. 5 and FIG. 6, the third gear unit 8 on the movable body 2 side is separated from the fourth gear unit 9 on the housing 3 side, and the first gear unit 6 on the movable body 2 side approaches the second gear unit 7 on the housing 3 side (see marks indicated by reference signs a and b in FIGS. 5 and 6).

After that, the first gear unit 6 on the movable body 2 side further approaches the second gear unit 7 on the housing 3 side, and the teeth 6*a* of the first gear unit 6 and the teeth 7*a* of the second gear unit 7 mesh with each other. That is, a transition is made from the state shown in FIG. 5 and FIG. 6 to the state shown in FIG. 7 and FIG. 8. In the process of this transition, since both of the teeth 6*a* of the first gear unit 6 and the teeth 7*a* of the second gear unit 7 are formed in a saw-tooth shape as shown, the first gear unit 6 (and the movable body 2 to which the first gear unit 6 is fixed) rotate relative to the second gear unit 7 (and the housing 3 to which the second gear unit 7 is fixed), from the state shown in FIG. 5 and FIG. 6 (see marks indicated by reference signs a and b in FIGS. 5 and 6), by a predetermined angle (for example, 15 degrees), upward in the figure (clockwise as viewed from the distal end portion 2*a*) (see marks indicated by reference signs a and b in FIGS. 7 and 8).

Figure 9:
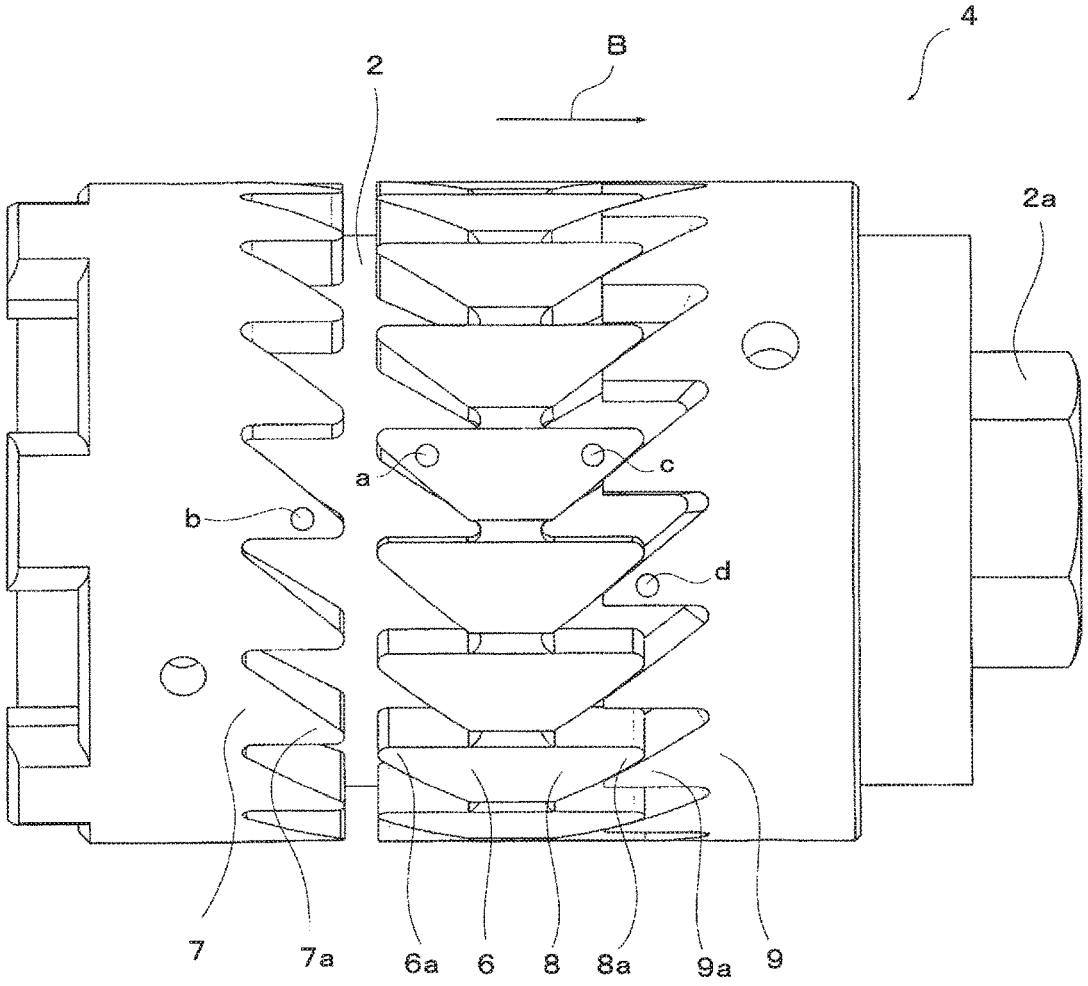
FIG. 9 is a diagram for illustrating the operation of the rotating mechanism unit in this embodiment.
Figure 10:
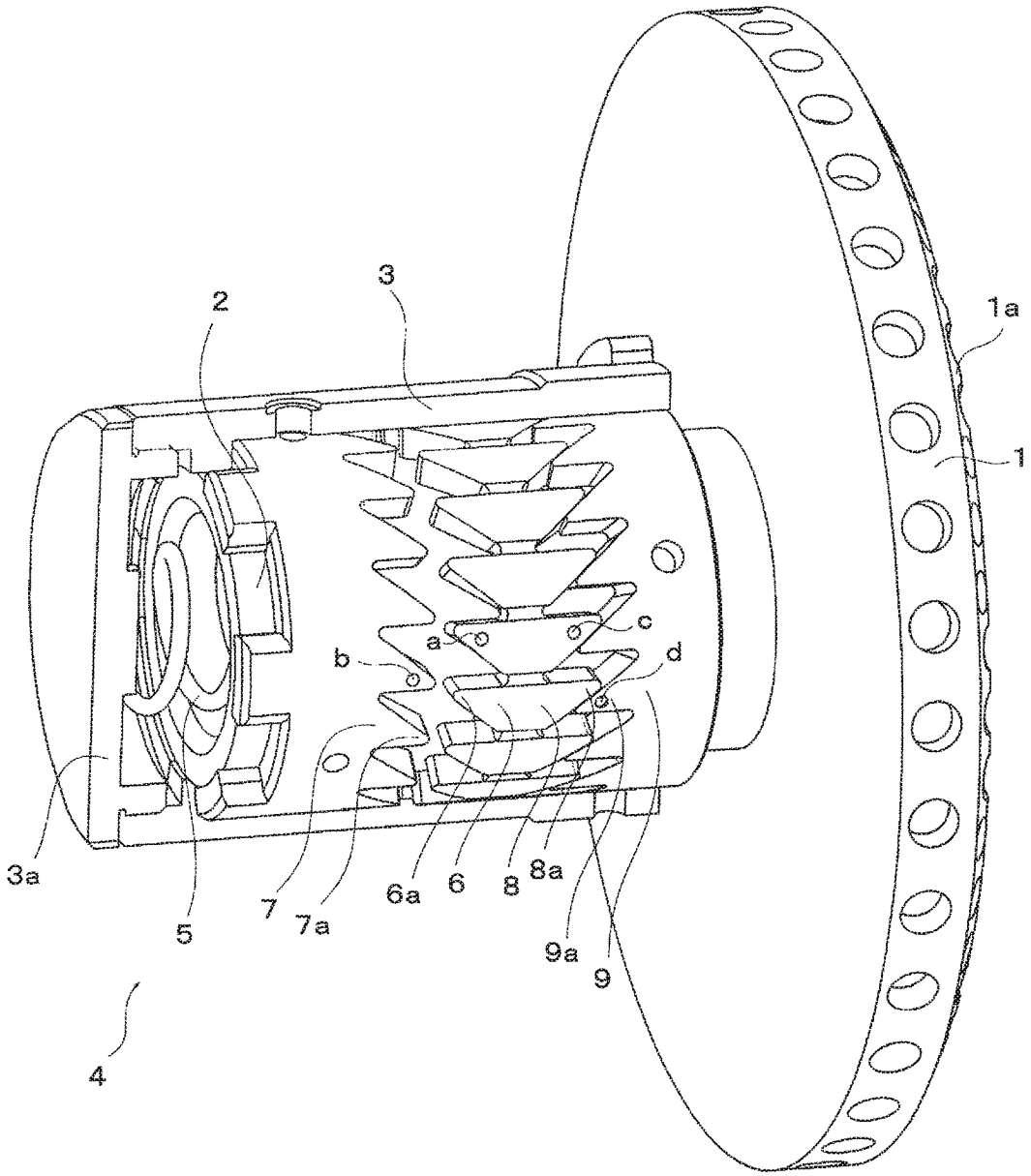
FIG. 10 is a diagram for illustrating the operation of the rotating mechanism unit in this embodiment.

Next, the operation in the case where the operation of pressing the surface shaving unit 1 against the tap hole surface is released by the drive mechanism of the conventional mud injection machine, and the surface shaving unit 1 is separated from the tap hole surface will be described with reference to FIG. 9 and FIG. 10. In this case, there is no longer the force of the drive mechanism of the conventional mud injection machine to press the surface shaving unit 1 against the tap hole surface, and therefore the movable member 2 is moved by the force of the spring 5 toward the tap hole surface (in the direction indicated by arrow B in FIG. 9). In the process of this movement, as shown in FIG. 9 and FIG. 10, the first gear unit 6 on the movable body 2 side is separated from the second gear unit 7 on the housing 3 side, and then the third gear unit 8 on the movable body 2 side approaches the fourth gear unit 9 on the housing 3 side. In that process, the teeth 8*a* of the third gear unit 8 mesh with the teeth 9*a* of the fourth gear unit 9 (see marks indicated by reference signs c and d in FIGS. 9 and 10).

Figure 5:
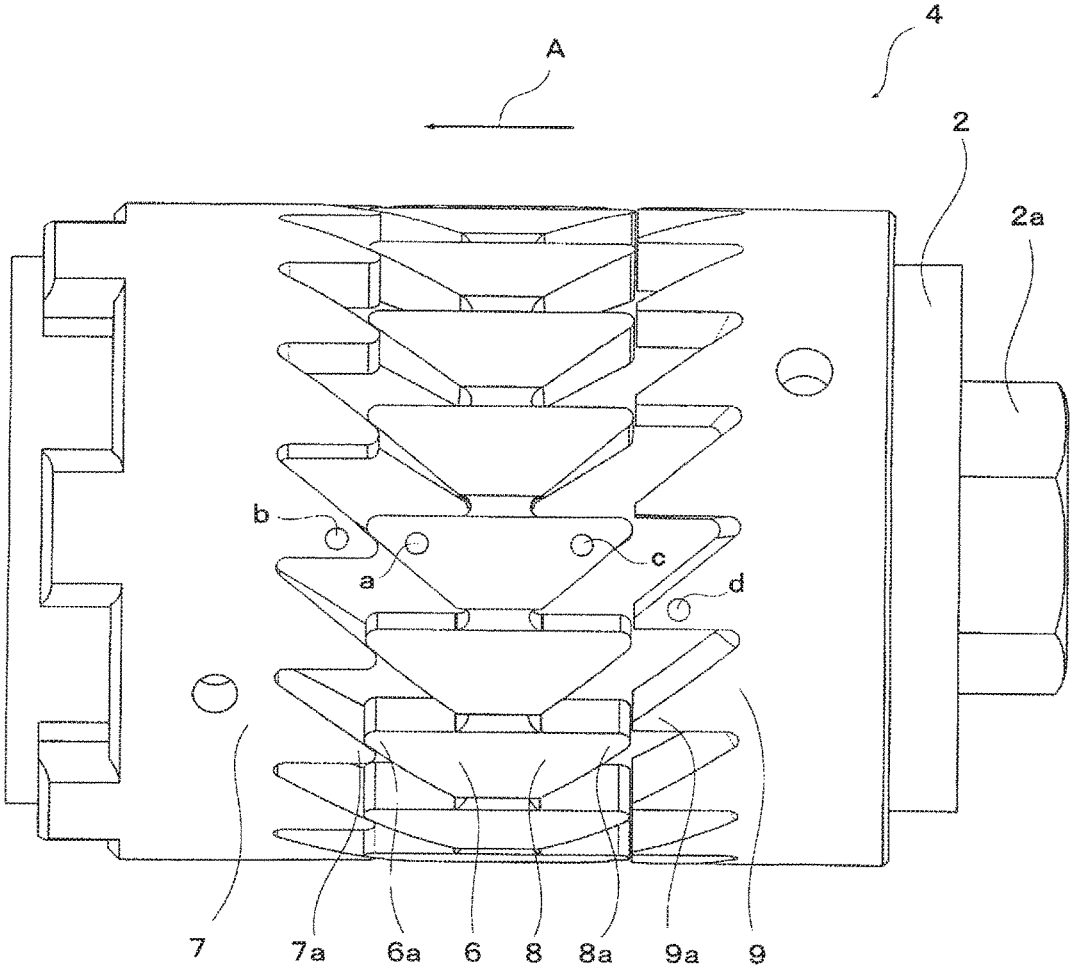
FIG. 5 is a diagram for illustrating the operation of the rotating mechanism unit in this embodiment.
Figure 6:
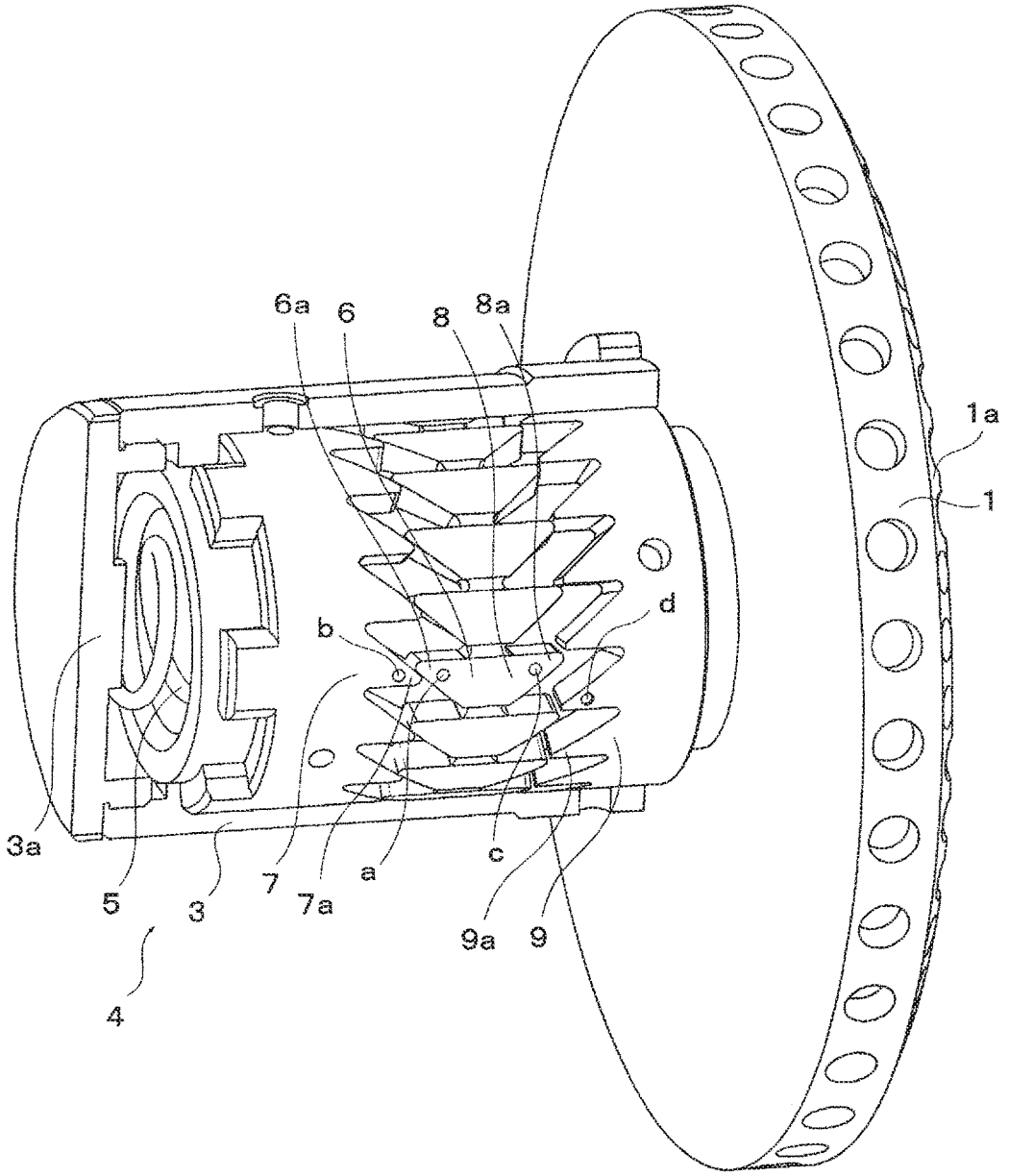
FIG. 6 is a diagram for illustrating the operation of the rotating mechanism unit in this embodiment.
Figure 7:
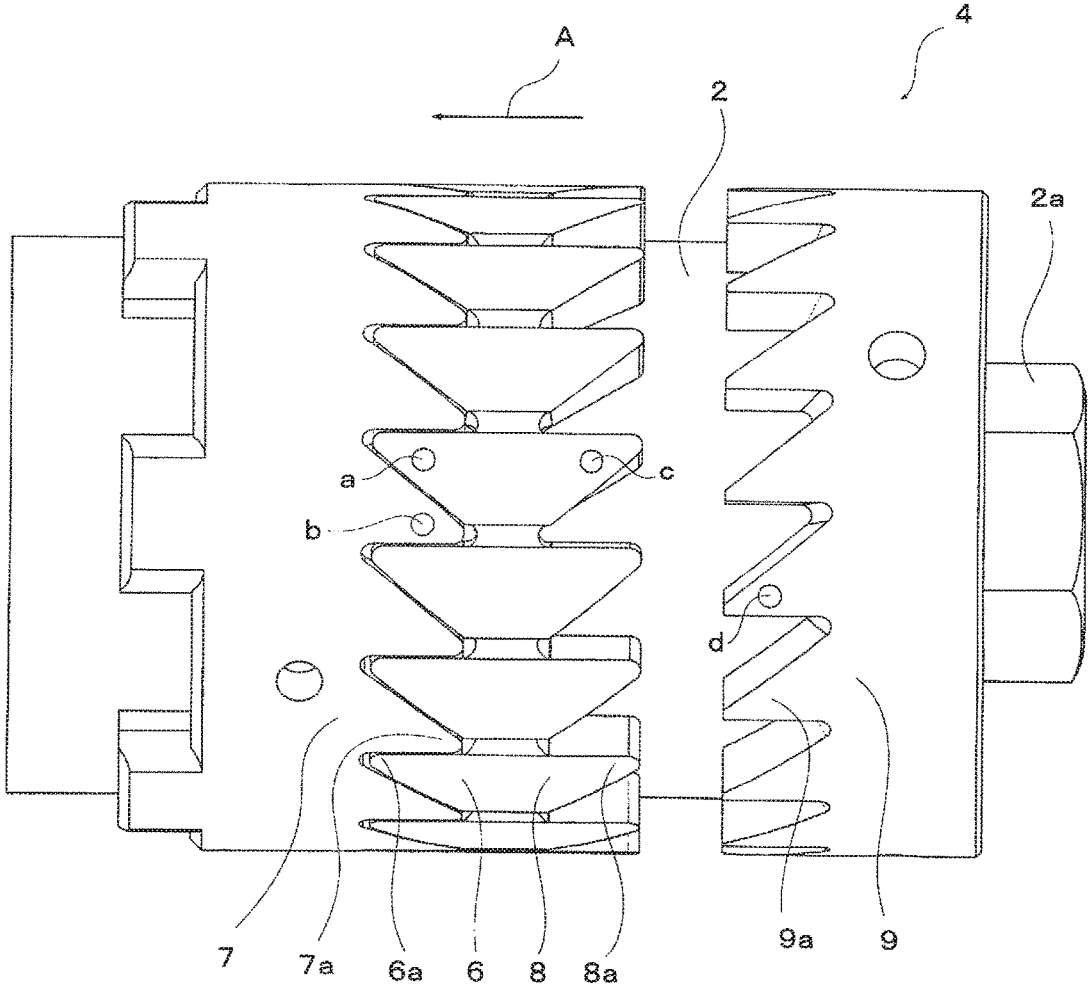
FIG. 7 is a diagram for illustrating the operation of the rotating mechanism unit in this embodiment.
Figure 8:
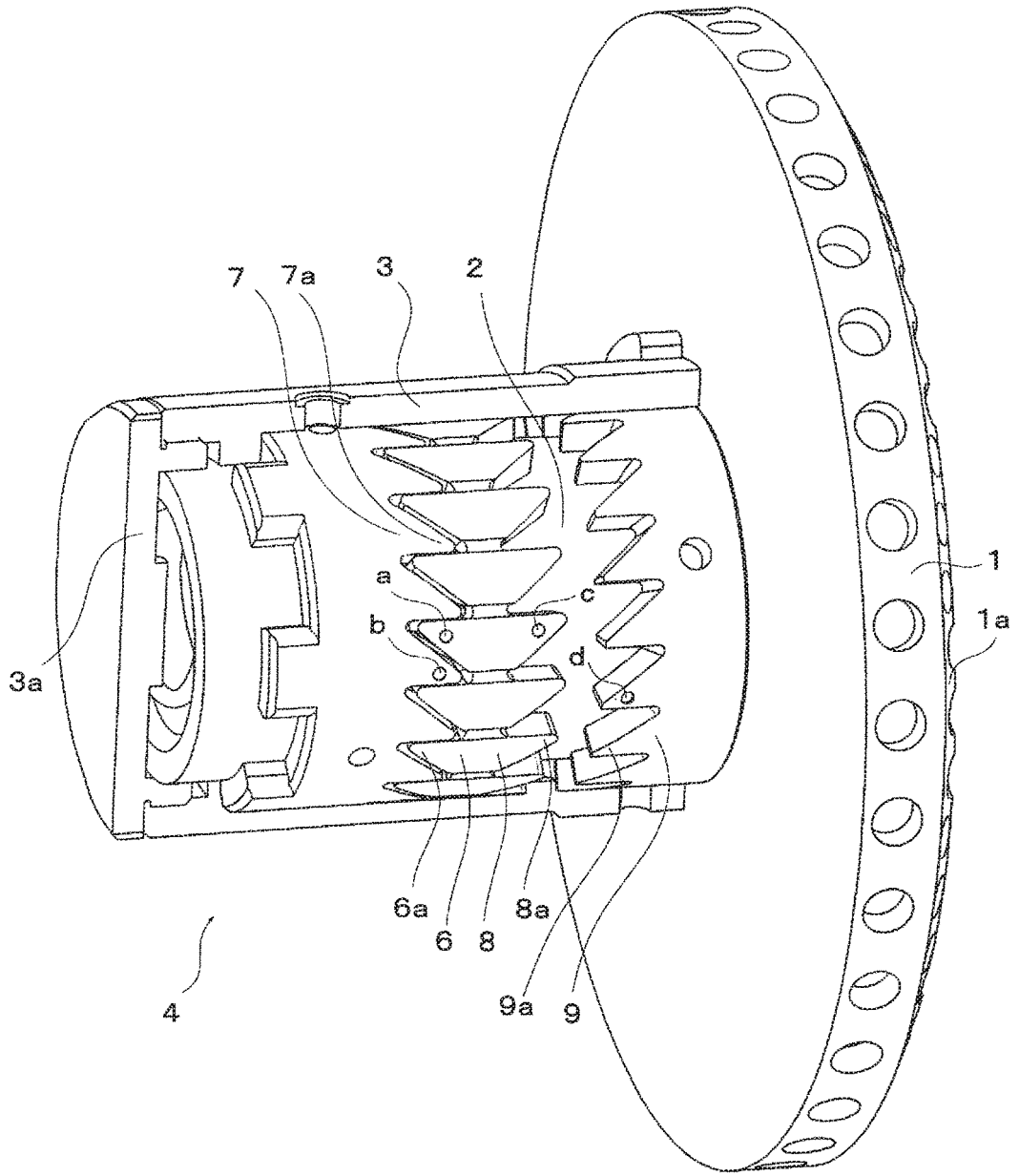
FIG. 8 is a diagram for illustrating the operation of the rotating mechanism unit in this embodiment.

At this time, as described above, the first gear unit 6 is rotated relative to the second gear unit 7, in the process of transition from the state shown in FIG. 5 and FIG. 6 to the state shown in FIG. 7 and FIG. 8, by a predetermined angle upward in the figure (see marks indicated by reference signs a and b in FIGS. 7 and 8). Therefore, the third gear unit 8 formed integrally with the first gear unit 6 is also rotated relative to the fourth gear unit 9 (the fourth gear unit 9 is fixed to the second gear unit 7 with the cylindrical portion 2 interposed therebetween), in the process of transition from the state shown in FIG. 5 and FIG. 6 to the state shown in FIG. 7 and FIG. 8, by a predetermined angle upward in the figure (see marks indicated by reference signs c and d in FIGS. 7 and 8).

Therefore, the teeth 8*a* of the third gear unit 8 mesh not with the same teeth as the teeth 9*a* of the fourth gear unit 9 that meshed in FIG. 3 and FIG. 4 (see marks indicated by reference signs c and d in FIGS. 3 and 4) but with different teeth whose phases are shifted upward in the figure (different teeth of the fourth gear unit 9 that newly face the teeth 8*a* of the third gear unit 8 as a result of movement by the predetermined angle) (see marks indicated by reference signs c and d in FIGS. 9 and 10).

Figure 11:
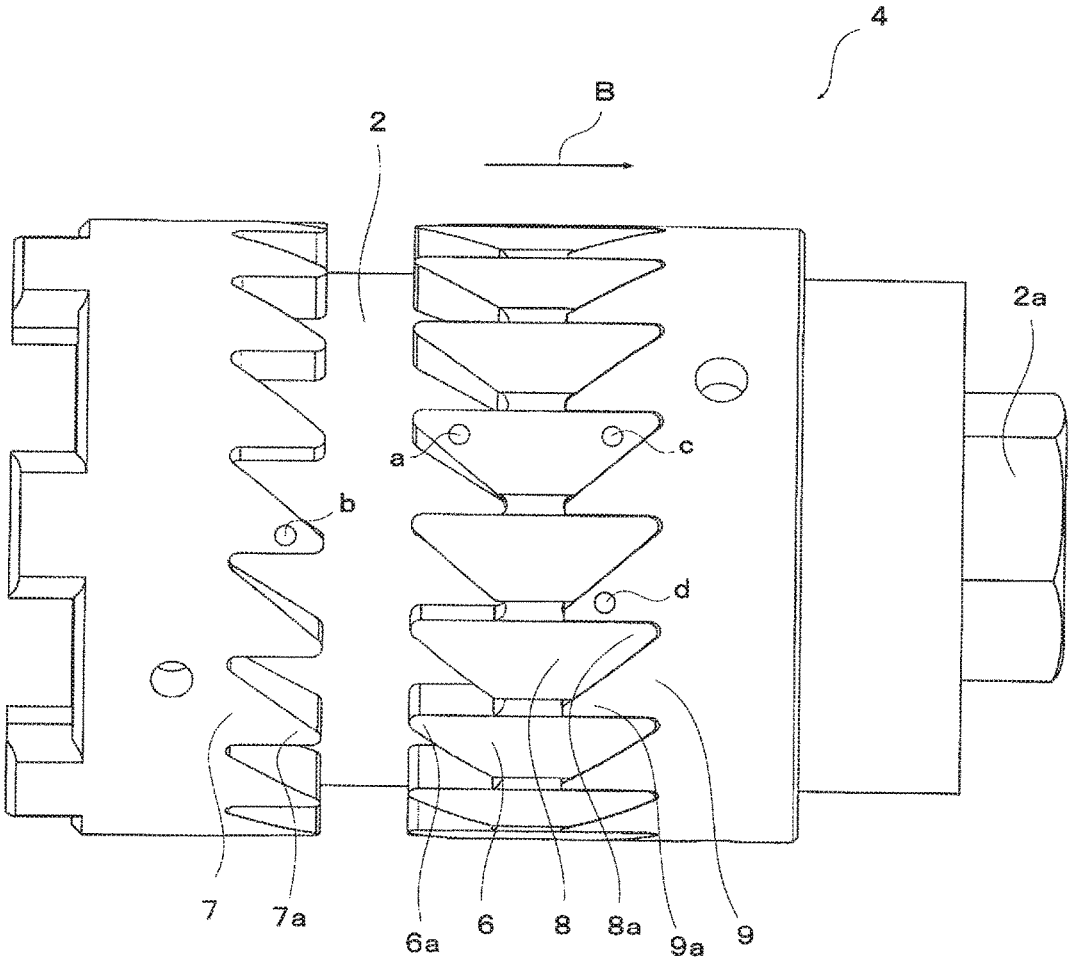
FIG. 11 is a diagram for illustrating the operation of the rotating mechanism unit in this embodiment.
Figure 12:
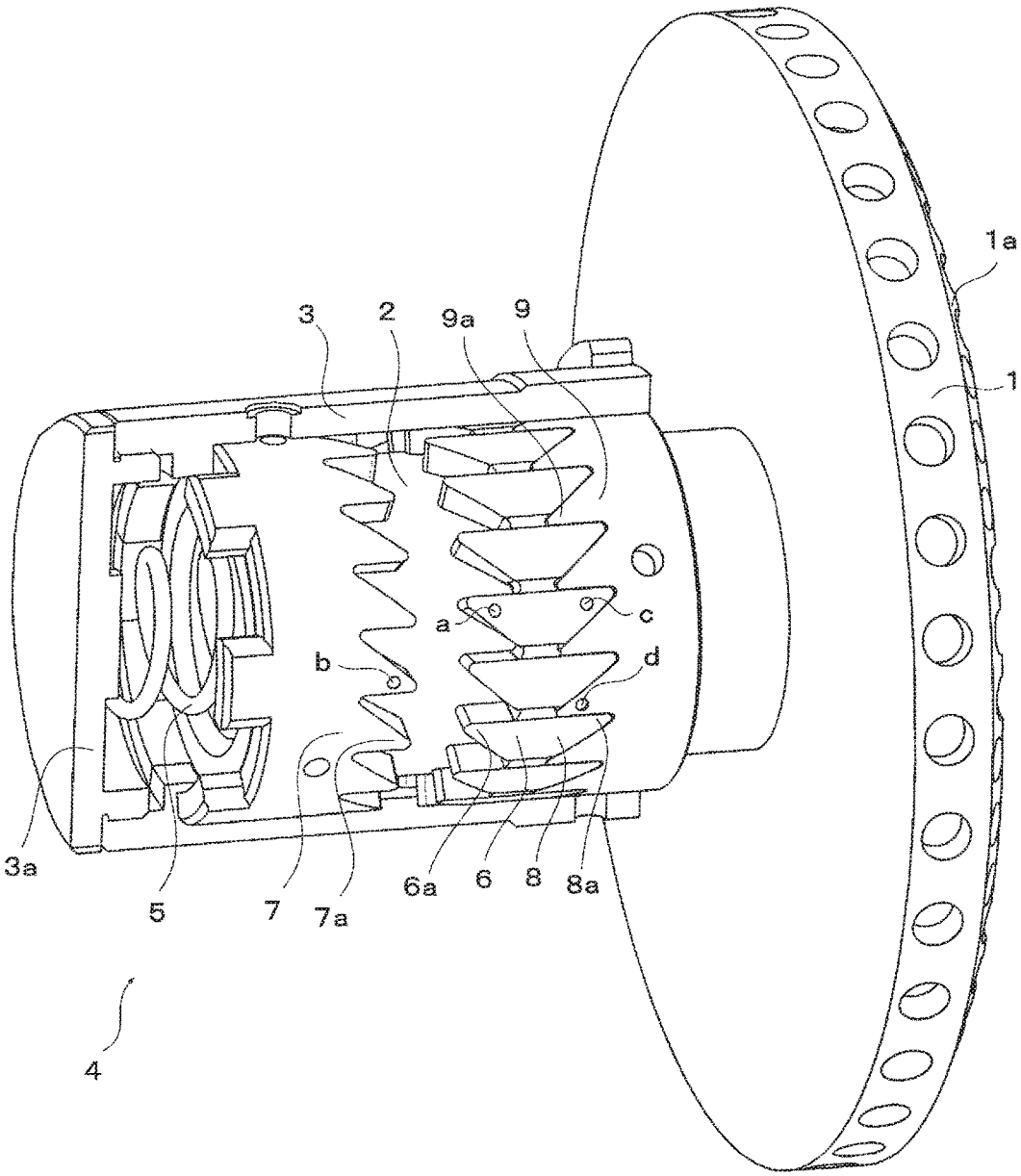
FIG. 12 is a diagram for illustrating the operation of the rotating mechanism unit in this embodiment.
Figure 13:
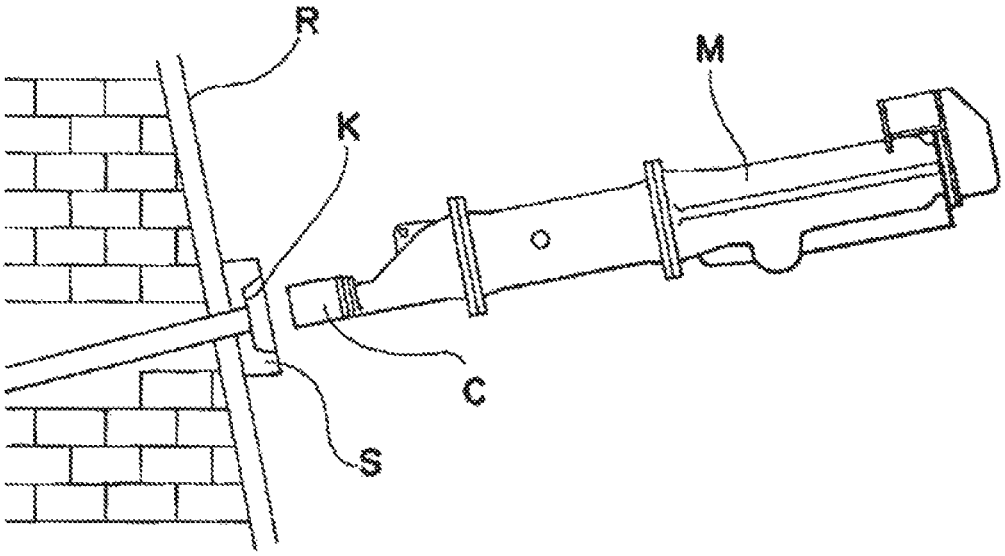
FIG. 13 is a diagram showing an example of a conventional apparatus for shaving a tap hole surface.

After that, in the process in which the third gear unit 8 on the movable body 2 side further approaches the fourth gear unit 9 on the housing 3 side (see arrow B in FIG. 11), and the teeth 8*a* of the third gear unit 8 and the teeth 9*a* of the fourth gear unit 9 mesh with each other, as shown in FIGS. 11 and 12, the third gear unit 8 (and the movable body 2 to which the third gear unit 8 is fixed, and the surface shaving unit 1 fixed to the movable body 2) rotate relative to the fourth gear unit 9 (and the housing 3 to which the fourth gear unit 9 is fixed), by a predetermined angle (for example, 15 degrees) upward in the figure (clockwise as viewed from the distal end portion 2*a*) (see marks indicated by reference signs c and d in FIGS. 11 and 12).

As described above, in this embodiment, when the surface shaving unit 1 of the apparatus for shaving a tap hole surface according to this embodiment is pressed (brought into contact and pressed) against the tap hole surface by the drive mechanism of the mud injection machine, the surface shaving unit 1 is rotated by the rotating mechanism unit, by utilizing pressing force when the surface shaving unit 1 is pressed against the tap hole surface (by converting the pressing force into rotational force), by a predetermined angle in a predetermined direction substantially parallel to the tap hole surface (the circumferential direction of the tubular body 3), and is held at the rotated position. Therefore, according to this embodiment, "the work such that the worker manually rotates the surface shaving unit by a predetermined angle between the operation of pressing the disk-like surface shaving unit against the tap hole surface and the operation of thereafter further pressing the surface shaving unit against the tap hole surface, that is, every time the surface shaving unit is separated from the tap hole surface after being pressed against the tap hole surface," which has been required in the work of shaving and smoothing the tap hole surface using the conventional apparatus for shaving a tap hole surface, can be made unnecessary at a low cost by simply adding a simple mechanical configuration, and as a result, the efficiency of the work of smoothing the tap hole surface of a blast furnace or the like can be improved greatly. According to the results of the experiments conducted by the inventors, the work of shaving and smoothing the tap hole surface that was performed using the conventional apparatus for shaving a tap hole surface while interposing the work of manually rotating the surface shaving unit by a predetermined angle, required a working time of about 20 minutes, whereas, when using the apparatus for shaving a tap hole surface according to this embodiment, working time was able to be shortened to about 5 minutes. According to this embodiment, making the worker perform a conventionally needed very hard work of manually rotating the surface shaving unit 1 by a predetermined angle in the vicinity of the lower furnace wall of the blast furnace under high temperature every time the surface shaving unit 1 is separated from the tap hole surface after being pressed against the tap hole surface, can be made unnecessary, and imposing such a large physical burden on the worker can be avoided.

In this embodiment, as described above, as a result of rotating the first gear unit 6 and the movable member 2 to which this is fixed, by a predetermined angle in a predetermined direction substantially parallel to the tap hole surface (circumferential direction of the housing 3) in the process in which the teeth of the first gear unit 6 mesh with the teeth of the second gear unit 7, the surface shaving unit 1 is rotated by a predetermined angle (for example, 15 degrees) in the process in which the surface shaving unit 1 is pressed against the tap hole surface. Thus, according to this embodiment, in the process in which the surface shaving unit 1 is pressed against the tap hole surface, the bits of the surface shaving unit 1 not only operate so as to shave the tap hole surface in the front-back direction (the direction toward and away from the tap hole) but also operate so as shave in the direction of rotation (a direction substantially parallel to the tap hole), and therefore, compared to the case where the surface shaving unit 1 is simply pressed against the tap hole surface in the front-back direction, the amount of shaving per single operation of pressing the surface shaving unit 1 against the tap hole surface can be significantly increased.

Since in this embodiment, the teeth 6*a* of the first gear unit 6 and the teeth 7*a* of the second gear unit 7 are each formed in a saw-tooth shape such that, when they mesh with each other, the first gear unit 6 rotates relative to the second gear unit 7 by a predetermined angle in a predetermined direction substantially parallel to the tap hole surface (the circumferential direction of the housing 3), and the teeth 8*a* of the third gear unit 8 and the teeth 9*a* of the fourth gear unit 9 are each formed in a saw-tooth shape such that, when they mesh with each other, the third gear unit 8 rotates relative to the fourth gear unit 9 by a predetermined angle in the predetermined direction (the circumferential direction of the housing 3), the rotating operation of the first gear unit 6 relative to the second gear unit 7 and the rotating operation of the third gear unit 8 relative to the fourth gear unit 9 can be achieved with a relatively simple and low-cost configuration.

Further, since in this embodiment, thrust bearings (not shown) are provided between an end portion of the spring 5 that is nearer to the surface shaving unit 1 and the distal end portion 2*a* (closed portion) of the movable body 2, and between an end portion of the spring 5 that is nearer to the bottom plate 3*a* of the housing 3 and the bottom plate 3*a*, interference with smooth rotating operation of the movable body 2 relative to the housing 3 caused by the friction between each end of the spring 5 and the housing 3, for example, the rotation of the spring 5 during the rotation of the movable body 2, can be effectively prevented.

Although an embodiment of the present invention has been described, the present invention is not limited to that described as the above embodiment, and various modifications and changes may be made. For example, although, in the above embodiment, the first gear unit 6 and the third gear unit 8 are formed integrally with each other, they may be formed as separate bodies in the present invention. In addition, although, in the description of the above embodiment, a conventional mud injection machine (that is originally provided with a mechanism for moving a mud injection nozzle toward and away from the tap hole surface) is used as a mechanical apparatus for moving the apparatus for shaving a tap hole surface according to the above embodiment (apparatus for shaving a tap hole surface including the surface shaving unit 1 and the rotating mechanism unit 4) toward and away from the tap hole surface, the present invention is not limited to this, and a mechanical apparatus provided with a drive mechanism separate from the mud injection machine may be used. Furthermore, although, in this embodiment, the rotation angle of the surface shaving unit 1 (first gear unit 6) is 15 degrees, the present invention is not limited to this, and it may be in the range of 2 degrees to 45 degrees, preferably 10 degrees to 20 degrees. The reason is that when it is greater than 20 degrees, smooth rotation may not be able to be obtained, and shaving efficiency is saturated, and when it is less than 10 degrees, shaving efficiency decreases.

REFERENCE SIGNS LIST

1 surface shaving unit
1*a* bit
2 movable body
2*a* distal end portion
3 housing
3*a* bottom plate of housing
4 rotating mechanism unit
5 spring
6 first gear unit
6*a*, 7*a*, 8*a*, 9*a* teeth
7 second gear unit
8 third gear unit
9 fourth gear unit

The invention claimed is:

1. An apparatus for shaving a tap hole surface of a blast furnace comprising:

a surface shaving unit that is pressed against a tap hole surface (a front surface of a tap hole and an area around it) of a blast furnace or the like and is used for shaving and smoothing the tap hole surface, and that has bits; and a rotating mechanism unit that, when the surface shaving unit is pressed against the tap hole surface, rotates the surface shaving unit, by utilizing the pressing force, by a predetermined angle in a predetermined direction substantially parallel to the tap hole surface, and holds the surface shaving unit at the rotated position, wherein the rotating mechanism unit includes a movable body to an end of which nearer to the tap hole surface the surface shaving unit is attached or fixed, a tubular body that houses the movable body movably toward and away from the tap hole surface, a first gear unit that is provided in the movable body and that moves toward a below-described second gear unit when the surface shaving unit is pressed against the tap hole surface, a second gear unit that is provided in a portion of the tubular body that is farther from the tap hole surface than the first gear unit, and that, in the process in which the first gear unit approaches itself and then teeth of the first gear unit and teeth of itself mesh with each other, rotates the first gear unit and the movable body to which the first gear unit is fixed, by a predetermined angle in a predetermined direction substantially parallel to the tap hole surface, a third gear unit that is provided in a portion of the movable body that is nearer to the tap hole surface than the first gear unit, and that, when the surface shaving unit is separated from the tap hole surface, moves toward a below-described fourth gear unit, and a fourth gear unit that is provided in a portion of the tubular body that is nearer to the tap hole surface than the third gear unit, and that, in the process in which the third gear unit approaches itself and then teeth of the third gear unit and teeth of itself mesh with each other, rotates the third gear unit and the movable body to which the third gear unit is fixed, by a predetermined angle in the predetermined direction.

2. An apparatus for shaving a tap hole surface of a blast furnace comprising:

a surface shaving unit that is pressed against a tap hole surface (a front surface of a tap hole and an area around it) of a blast furnace or the like and is used for shaving and smoothing the tap hole surface, and that has bits; and a rotating mechanism unit that, when the surface shaving unit is pressed against the tap hole surface, rotates the surface shaving unit, by utilizing the pressing force, by a predetermined angle in a predetermined direction substantially parallel to the tap hole surface, and holds the surface shaving unit at the rotated position, wherein the rotating mechanism unit includes a movable body to an end of which nearer to the tap hole surface the surface shaving unit is attached or fixed, a tubular body that houses the movable body movably toward and away from the tap hole surface, a first gear unit that is provided in the movable body and that moves toward a below-described second gear unit when the surface shaving unit is pressed against the tap hole surface, a second gear unit that is provided in a portion of the tubular body that is farther from the tap hole surface than the first gear unit, a third gear unit that is provided in a portion of the movable body that is nearer to the tap hole surface than the first gear unit, and that, when the surface shaving unit is separated from the tap hole surface, moves toward a below-described fourth gear unit, and a fourth gear unit that is provided in a portion of the tubular body that is nearer to the tap hole surface than the third gear unit, and wherein teeth of the first gear unit and teeth of the second gear unit are each formed in a saw-tooth shape such that, in the process in which the first gear unit approaches the second gear unit and then the teeth of the first gear unit and the teeth of the second gear unit mesh with each other, the first gear unit and the movable body to which the first gear unit is fixed rotate by a predetermined angle in a predetermined direction substantially parallel to the tap hole surface, and teeth of the third gear unit and teeth of the fourth gear unit are each formed in a saw-tooth shape such that, in the process in which the third gear unit approaches the fourth gear unit and then the teeth of the third gear unit and the teeth of the fourth gear unit mesh with each other, the third gear unit and the movable body to which the third gear unit is fixed rotate by a predetermined angle in the predetermined direction.

3. The apparatus for shaving a tap hole surface of a blast furnace according to claim 1, further comprising a spring that urges the movable body relative to the tubular body in the direction of the tap hole surface.

4. The apparatus for shaving a tap hole surface of a blast furnace according to claim 3, wherein a thrust bearing is provided between each end of the spring and the tubular body.

5. The apparatus for shaving a tap hole surface of a blast furnace according to claim 2, further comprising a spring that urges the movable body relative to the tubular body in the direction of the tap hole surface.

6. The apparatus for shaving a tap hole surface of a blast furnace according to claim 5, wherein a thrust bearing is provided between each end of the spring and the tubular body.

* * * * *